United States Patent [19]

Roberts

[11] Patent Number: 4,848,097

[45] Date of Patent: Jul. 18, 1989

[54] APPARATUS FOR TRANSFERRING WATER FROM A CONTAINER TO A REFRIGERATOR ICE MAKER

[76] Inventor: Mark J. Roberts, 6344 E. Frost, Mesa, Ariz. 85205

[21] Appl. No.: 220,320

[22] Filed: Jul. 18, 1988

[51] Int. Cl.[4] ..... F25C 1/00

[52] U.S. Cl. ..... 62/135; 62/340; 417/44; 417/435

[58] Field of Search ..... 62/340, 132, 135; 417/43–45, 36, 435

[56] References Cited

U.S. PATENT DOCUMENTS

| | | | |
|---|---|---|---|
| 2,239,481 | 4/1941 | Christensen | 417/44 |
| 2,675,757 | 4/1954 | Moore | 417/44 X |
| 2,915,019 | 12/1959 | Erikson et al. | 417/435 X |
| 2,973,779 | 3/1961 | Kennedy | 417/435 X |
| 4,027,499 | 6/1977 | Barto et al. | 62/340 |
| 4,265,262 | 5/1981 | Hotine | 417/36 X |
| 4,476,889 | 10/1984 | Haynes | 417/44 X |
| 4,597,270 | 7/1986 | Kerr | 62/340 X |

*Primary Examiner*—William E. Tapolcai
*Attorney, Agent, or Firm*—H. Gordon Shields

[57] ABSTRACT

Water is pumped from a container to a refrigerator ice maker and/or chilled water unit. The apparatus for transferring the water includes a motor operated pump, and the motor includes a pair of switches in series for turning the motor off. The switches include a pressure switch actuated from water pressure in the pumped water line and a switch to indicate when the water level in the container is at or below a certain, predetermined minimum. A check valve is in the pumped water line between the pump and the pressure switch to prevent loss of pressure in the line due to the bleeding of pressure through the pump that could otherwise cause the pump to start pumping water when there was no demand for it from the refrigerator.

8 Claims, 1 Drawing Sheet

APPARATUS FOR TRANSFERRING WATER FROM A CONTAINER TO A REFRIGERATOR ICE MAKER

BACKGROUND OF THE INVENTION

1. Field of the Invention

This invention relates to the providing of water for an automatic ice maker and a cool water dispenser of a refrigerator and, more particularly, to the pumping of water from a water container rather than from a pressurized water line utilizing a switch controlled pump.

2. Description of the Prior Art

Refrigerators having ice makers and/or chilled water dispensers are typically connected to a pressurized water line in the structure in which the refrigerator is located. This means that the city water supply, which is the typical source for the pressurized water line, will provide the water for the ice cubes and for drinking. Very often, water in the city water supply is chlorinated, and the chlorine taste is carried through the water lines and into the ice cubes, etc. Moreover, the water typically includes particulates, etc., that cause the ice cubes to be cloudy and, when melted, to leave a residue in the container in which the ice cubes are disposed, such as in glasses, etc. This is often very undesirable.

Alternatives to utilizing city water lines for connection to refrigerators include filling ice cube trays manually from a bottled water dispenser, maintaining containers of cool water in the refrigerator for normal use, using bottled water and coolers, and filters connected to tap water.

An alternative to using a city water line water for automatic ice makers has been suggested in prior art patents, but each of the patents includes certain deficiencies, and those deficiencies are overcome by the apparatus of the present invention.

U.S. Pat. No. 3,796,063 (Wulke et al) discloses a portable ice cube making apparatus in which a water supply is provided from a water source to a reservoir. Water flows by gravity from the reservoir to the ice cube making apparatus.

U.S. Pat. No. 3,969,909 (Barto et al) discloses an alternative to the general prior art discussed above in that it provides for the pumping of water from a water reservoir disposed adjacent to the refrigerator. A switch responsive to water pressure is used to control water pumped from a water source to a reservoir at the top of a refrigerator. Water flows from the reservoir again by means of a pump, to the ice cube maker and to the water dispenser reservoir.

U.S. Pat. No. 3,983,583 (Herman et al) discloses a portable bar system in which a pump is used to pump water from a water container within the portable bar to an ice cube maker and another pump is used to supply a faucet.

U.S. Pat. No. 4,027,499 (Barto et al) is similar to the above discussed U.S. Pat. No. 3,969,909 patent insofar as the pumping system is concerned. Again, water is pumped from a water supply to a reservoir, and the water is then pumped from the reservoir to an automatic ice maker.

SUMMARY OF THE INVENTION

The invention described and claimed herein comprises a water pumping system for pumping water from a container to a refrigerator for using the pumped water in an ice maker, a chilled water dispenser, etc. an electric motor for pumping the water is controlled by a pair of switches, including a switch which detects a low water level and a pressure sensitive switch responsive to pressure in the pumped water line. The pumped water line also includes a check valve for maintaining a predetermined pressure in the pumped water line from which the pressure sensitive switch derives its pressure.

Among the objects of the present invention are the following:

To provide new and useful water pumping apparatus;

To provide new and useful apparatus for pumping water from a container to a refrigerator;

To provide new and useful water pumping apparatus having a pair of switches to automatically control an electric motor connected to a water pump;

To provide new and useful pumping apparatus having a switch responsive to a predetermined water level for controlling an electric motor operating a water pump; and To provide new and useful apparatus for pumping water from a reservoir to a refrigerator and utilizing threr switches and a check valve, with one switch responsive to water pressure in the water line, one switch responsive to a predetermined low water level, and one manual switch or valve for venting the pressurized water line for priming the pump.

DESCRIPTION OF THE PREFERRED EMBODIMENT

Figure 1:
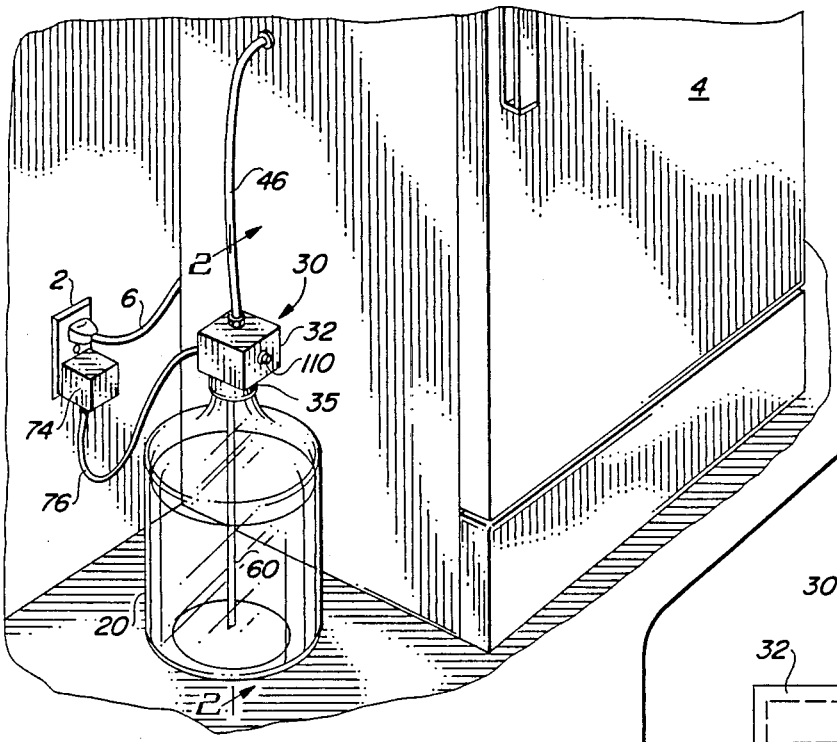
FIG. 1 is a perspective view of the apparatus of the present invention in its use environment.

FIG. 1 is a perspective view of the apparatus of the present invention in its use environment. The use environment includes a wall outlet 2 and a refrigerator 4. The refrigerator 4 is connected to the wall outlet 2 by a line cord 6.

A water container 20 is disposed adjacent to the refrigerator 4 and to the wall outlet 2. Water supply apparatus 30 of the present invention is connected to the water container 2 and to the refrigerator 4.

Figure 3:
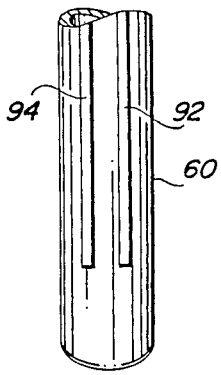
FIG. 3 is an enlarged view taken generally along line 3—3 of FIG. 2.
Figure 2:
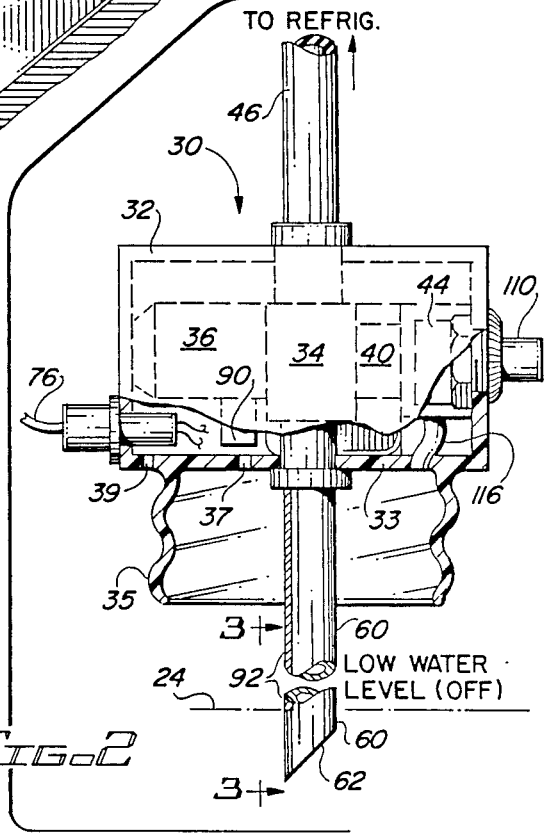
FIG. 2 is an enlarged view in partial section, and partially schematic, taken generally along line 2—2 of FIG. 1.
Figure 4:
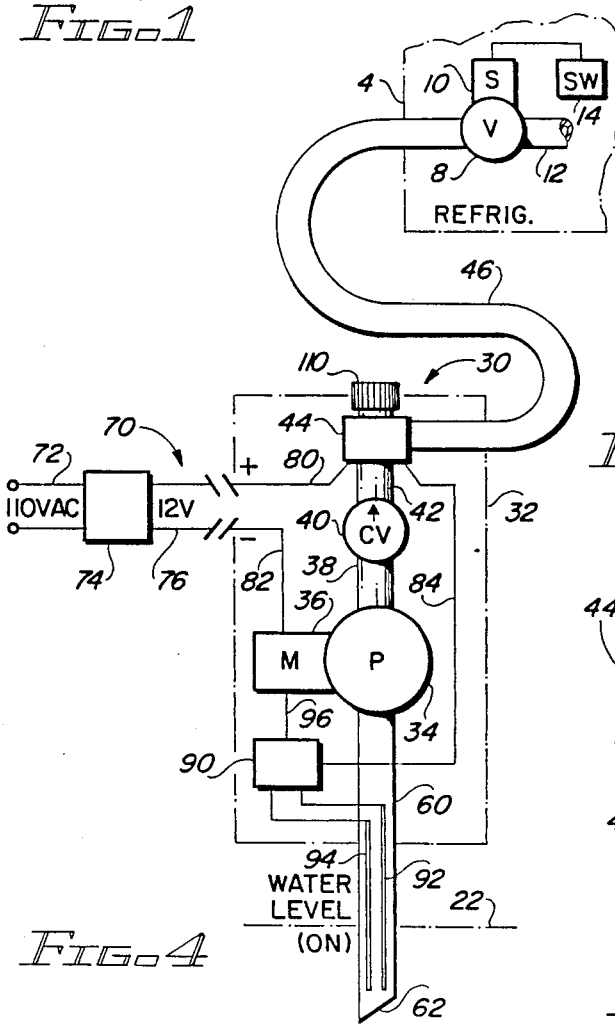
FIG. 4 is a schematic diagram of the apparatus of the present invention illustrating the circuitry involved in the apparatus of the present invention and its use environment.
Figure 5:
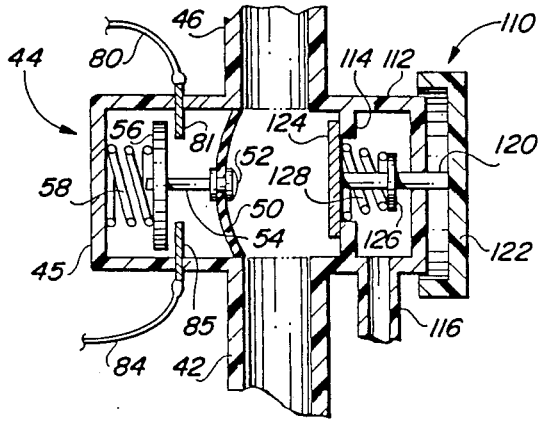
FIG. 5 is a schematic diagram in partial section of a portion of the apparatus of the present invention.

FIG. 2 is an enlarged view in partial section of the water supply apparatus 30 of the present invention. FIG. 3 is an enlarged view of a portion of the water supply apparatus 30 taken generally along line 3—3 of FIG. 2. FIG. 4 is a schematic representation of the water supply apparatus 30 and the refrigerator 4, schematically illustrating both the water supply elements and the electrical elements associated therewith. FIG. 5 is a schematic diagram in partial section of a portion of the apparatus of the present invention, schematically illustrating two of the switches. For the following discussion, reference will be made to all five Figures.

For purposes of the present invention, the water container 20 includes two different water levels, a permissable or operational water level 22 shown in FIG. 4, and a low water level or unpermissable or inoperable water level 24 illustrated in FIG. 2.

The water supply apparatus 30 of the present invention includes a housing 32 which is disposed on the water container 20. The water container 20 may be an appropriate glass or plastic container which simply holds a quantity of purified/demineralized water. That is, the water within the container 20 does not include the typical minerals and chemicals found in community water supply systems. The housing 32 is connected to the water container 20 by a flexible skirt connector 35, shown in FIG. 2, which extends downwardly from the housing 32. The skirt 35 is designed to mate, or to be connected, with the neck of the bottle or water container 20.

The housing 32 includes a bottom wall 33. The skirt connector 35 extends downwardly from the bottom wall 3. Extending through the bottom wall 33 are two apertures, an aperture 37, which is disposed within the skirt 35, and an aperture 39, which is outside of the skirt 35. The aperture 37 and the aperture 39 provide atmospheric pressure within the housing 32 and within the water container 20. As will be discussed later, a conduit 116 also extends through the bottom wall 33.

Within the housing 32 is an electric pump 34. The pump 34 is controlled by a motor 36. A water conduit 60 extends downwardly from the pump 34 an the housing 52 and into the water container 20. The conduit 60 terminates in a slant or diagonally cut end 62 adjacent to the bottom of the water bottle 20. From the pump 34, a water conduit 38 extends to a check valve 40. The check valve 40 is a one-way check valve which allows for the flow of water from the pump 34 to the conduit 38 and from the valve 40 to a conduit 42. However, the check valve 40 prevents water from flowing backwards from the conduit 42 to the conduit 38. Thus, when the pump 34 ceases pumping, the check valve 40 assures that the conduit 42 will not be drained of water. The significance of this will be discussed below.

From the conduit 42, water flows by a low pressure control switch 44 and to a conduit 46. The conduit 46 in turn extends to the refrigerator 4. A vent valve or prime switch 110 is also connected to the conduits 42 and 46. The switch 110 will be discussed in more detail below.

The conduit 46 is connected to an ice maker system within the refrigerator 4. In FIG. 1, the conduit 46 is shown extending through a side wall of the refrigerator 4, but this is for illustrative purposes only. As is well known and understood, water connections for ice maker systems within refrigerators are typically through the rear wall of the refrigerator.

As shown in FIG. 4, a typical ice maker system in a refrigerator includes a valve 8 controlled by a solenoid 10, and a water supply line 12 which extends from the valve 8 to an ice maker. The solenoid 10 is controlled by a sensor 14 which senses the need for water. The sensor 14 is typically a mechanical switch which closes when ice cubes are removed or when the level of ice cubes in a container drops below a particular level.

When the solenoid 10 is turned on, the valve 8 opens to allow water to flow through the valve 8 and through the water supply line 12 to the ice maker.

In the apparatus of the present invention, when the valve 8 opens, pressure in the line 46 decreases, and the switch 44 closes to actuate the motor 36 for the pump 34 to provide a flow of water from the conduit 60 to the conduit 46. As will be explained below, the pump 34 is actuated to increase the fluid pressure. When the solenoid 10 turns the valve 8 off, water pressure in the conduit 46 increases. When the pressure increases above a preset maximum, the switch 44 opens and causes the pump 34 to turn off.

The water pressure in the conduit 46, and also in the conduit 42, is maintained because of the check valve 40. As long as the water pressure is maintained across the switch 44, the pump 34 remains off. However, when the valve 8 opens again, to provide additional water to the ice maker, the pressure in line 46 drops and the drop in water pressure is again sensed by the switch 44. The switch 44 turns the pump 34 on by actuating its motor 36.

FIG. 4 comprises a schematic circuit diagram combining the electrical system of the apparatus 30 of the present invention with the water system of both the refrigerator 4 and the apparatus of the present invention. FIG. 4 discloses an electrical system 70 for the water supply apparatus 30. The electrical system 70 includes a line current connection 72 and a transformer 74. The transformer 74 is for the purpose of transforming a 110 volt ac line current down to twelve volts. The transformer 74 also includes a rectifier for providing 12 volt dc power for operating the motor 36. It is obvious that, if desired, the motor 36 could also utilize line current if desired. However, for safety considerations, the utilization of 12 volt dc current may be preferable. Accordingly, the following discussion assumes the utilization of 12 volt dc current for the electrical circuitry 70.

From the transformer 74, a conductor pair 76 extends to the housing 32. At the housing 32, the conductor pair 76 separates into a pair of conductors 80 and 82. The conductor 80 is a positive conductor, and the conductor 82 is a negative or ground conductor. The conductor 80 extends to the pressure sensitive switch 44. From the switch 44, a conductor 84 extends to a water level switch 90. The water level switch 90 includes two conductors, a conductor 92 and a conductor 94. As best shown in FIGS. 2 and 3, conductors 92 and 94 are disposed on the outside of the conduit 60. The bottom of the conductors 92 and 94 are disposed slightly above the bottom or end 62 of the conduit 60. As long as the conductors 92 and 94 are disposed beneath the water level 22, current will flow between the conductors 92 and 94 to complete a circuit to the switch 90. This is shown in FIG. 4.

With the conductors 92 and 94 completing a circuit through the switch 90, the conductor 84 is connected by the switch 90 to a conductor 96. The conductor 96 extends from the switch 90 to the motor 36. The conductor 82 extends from the motor 36 to the conductor pair 76 to complete the circuitry for operating the motor 36 and the pump 34.

Thus, with water level 22 above the bottom of the conductors 92 and 94, the electrical circuitry is completed from the transformer 74 to the switch 44, and from the switch 44 through the switch 90 and the motor 36 back to the transformer 74. However, the motor 36 will only be operative when the switch 44 is closed. The opening and closing of the switch 44 depends on the water pressure in the conduit 46, as discussed above and as will be explained below.

In FIG. 2, a low water level 24 is illustrated. The water level 24 is slightly below the bottom of the conductors 92 and 94. Accordingly, the circuit between the conductors 92 and 94 is broken, and the switch 90 will accordingly also be open, disconnecting the conductor 84 from the conductor 96. This opens the circuit and prevents the motor 36 from operating. A user of the apparatus 30 will accordingly have to refill the water container 20 before the apparatus will be able to supply water to the ice maker in the refrigerator 4.

At such time as the water level, such as the water level 22, is above the conductors 92 and 94, as shown in FIG. 4, the switch 44 will be operative to control the motor 36 for the pump 34.

The switch 90, with its conductors 92 and 94, comprises a safety feature which prevents the motor 36 from operating when there is no water to be pumped by the pump 34.

A prime switch 110 is a manual switch, as shown in FIG. 2 and in FIG. 5. It comprises a vent switch or valve to vent air from the conduits 42 and 46 when the pump 34 loses its prime. If or when water drains from the conduit 60, the pump 34 loses its prime and pumps air instead of water. The air must be vented from the conduits 42 and 46 in order to allow the pump 34 to pump water.

The prime switch 110 will typically be used when a new container 20 is installed if the conduit 60 empties. When the water level 24 in the container 20 is below the level desired, or when the container 20 is effectively empty, the apparatus 30 will be removed from the bottle or container 20 and a new bottle or container full of water will be brought to the refrigerator 4. The apparatus 30 will then be installed on the new container 20, the full container 20, and the prime switch 110 may need to be actuated to prime the pump 34.

When the apparatus 30 is removed from the old container 20, and installed in a new container 20, there may be air in the line or conduit 60. The air in the conduit 60 will be vented to the atmosphere as the switch 110 is actuated, thus allowing the line or conduit 60, and the pump 34, to fill with water. The venting is accomplished through the switch or valve 110 as illustrated in FIG. 5. The air bled from the conduit 60 and from the motor 34, and any water in the conduits 42 and 46, are vented to atmospheric pressure, by returning them to the container 20. The air and water are replaced by water from the new container 20.

If, for some other reason, air is allowed to get into the system so as to cause the pump 34 to lose its prime, the prime switch 110 may be actuated to allow the air to be bled from the system. The air is then replaced by water to provide the priming action for the pump 34.

In FIG. 5, the operation of the low pressure control switch 44 and the operation of the prime switch or vent valve 110 is also illustrated. The following discussion should be reviewed in conjunction with FIGS. 2 and 4, as well as FIG. 5.

Conduits 42 and 46 extend from the check valve 40 upwardly to connect with the refrigerator 4. Water pressure in conduits 42 and 46 is the same, and that pressure will be across switch 44.

Switch 44 includes a housing 45 which is connected to the conduits 42 and 46. Within the housing 45, and essentially at the juncture of the conduits 42 and 46, is a flexible diaphragm 50. The diaphragm 50 includes a pair of plates 52 secured to the center portion of the diaphragm 50. A stem 54 is secured to the pair of plates. The pair of plates is secured on opposite sides of the diaphragm 50, in a well-known manner, and the stem 54 extends outwardly or away from the diaphragm 50 within the housing 45.

Secured to the stem 54, remote from the diaphragm 50, is a conductive plate or element 56. A compression spring 58 is disposed about the stem 50 and extends between an outer end wall of the housing 45 and the plate 56. The compression spring 58 urges the plate 56, and the stem 54 and the diaphragm 50 towards the conduits 42 and 46.

Within the housing 45, and between the conductive plate 56 and the diaphragm 50, is a pair of electrical contacts 81 and 85. The conductor 80 is connected to the conductive element or terminal 81. The conductor 84 is connected to the conductive element or terminal 85. The compression spring 58 urges the conductive plate against the electrical elements or terminals 82 and 85 to complete the electrical circuit between the conductors 80 and 84.

Water pressure in the conduits 42 and 46 biases the diaphragm 50. When the water pressure in the conduits 42 and 46, against the diaphragm 50, is greater than the bias of the compression spring 58, the diaphragm 50 will be flexed away from the conduits 42 and 46 to cause the conductive plate 56 to open the circuit between the conductive elements 81 and 85, thus opening the circuit between the conductors 80 and 84. Thus, when the solenoid 10 opens the valve 8 within the refrigerator 4, low water pressure in the conduits 42 and 46 will cause the circuit including the conductors 80 and 84, and their respective terminals 81 and 85, to be closed by the conductive plate 56 under the bias of the compression spring 58. This will cause the motor 36 to operate, as discussed above. With the motor 36 operating, or turned on, the pump 34 will pump water until the demand for the water in the refrigerator 4 is met. At such time as the demand for the water is met, the valve 8 will be closed by the solenoid 10, and water pressure in the conduits 42 and 46 will increase. The increased water pressure will cause the diaphragm 50 to move against the bias of the spring 58, as discussed above, to open the electrical circuit, and thus to turn the motor 36 off.

The check valve 40 prevents a loss of the water pressure in the conduits 42 and 46, and thus the motor 36, and the pump 34, will be off until pressure drops in the conduits 42 and 46 as the result of the opening of the valve 8 by the solenoid 10.

The prime switch or vent valve 110 is disposed adjacent to the low pressure control switch 44, also adjacent to the juncture of the conduits 42 and 46. The prime switch or vent valve 110 is used to vent the conduits 42 and 46 in the event that the pump 34 loses its prime by the introduction of air into the conduit 60 or the conduit 46, as the case may be. Typically, as water is lost from the conduit 60, thus providing air in the conduit 60, the pump 34 may lose its prime. With the pump 34 losing its prime, it would pump air and be in danger of burning out if the vent valve or prime switch 110 were not connected in the water circuit. Obviously, if there is no water in the conduit 46, when the valve or switch 110 is open, the water will flow out of the conduit 46. As shown in FIGS. 2 and 5, the valve or switch 110 is connected by a conduit 116 to allow water to flow back to the water container 20. Similarly, air vented from the conduits 42 and 46 and also from conduits 60 and 38 through the pump 34 and the check valve 40, is also vented to atmospheric pressure through the conduit 116.

The switch or valve 110 includes a housing 112. The housing 112 includes an apertured wall 114 adjacent to the juncture of the conduits 42 and 46.

A rod or stem 120 extends out of the housing 112 remote from the apertured wall 114. The rod or stem includes a cap or button 122 outside of the housing 112 and a valve element 124 within the housing 112 and adjacent to the apertured wall 114. The stem 120 extends through the apertured wall 114 and the valve element 124 is disposed on one end of the stem or rod 120 remote from the cap or button 122.

A spring stop element 126 is secured to the stem 120 within the housing 124. A compression spring 128 is disposed about the stem 120 and it extends between the wall 114 and the spring stop element 126. The compression spring 128 urges the valve element 124 against the aperture in the wall 114 to seal the aperture 114. It is only when the cap or bottom 122 is manually depressed that the valve element 124 is moving away from the aperture in the wall 114 to provide communication between the conduits 42 and 46 that either air or water is able to flow from the conduits 42 and/or 46 through the apertured wall 114, and into the housing 112 and outwardly from the housing 112 through the conduit 116. Thus, positive action by a user of the apparatus 30 is required in order to vent the apparatus to allow the pump 34 to the be primed when it has lost its prime due to air getting into the conduit 60 and the pump 34.

An appropriate seal will, of course, be provided for the stem 120 as it extends through an end wall of the housing 112.

If desired, lights could be used to provide an indication of the operation of the pump 34 (or its motor 36), and an indication of the low water state. Moreover, if desired, the housing 32 may be disposed adjacent to the bottle 20, instead of on top of it. In such case, only the conduit 60 would extend into the bottle 20. Also, the pump 34 and its motor 36 and the associated elements may be built into the refrigerator 4, if desired. In such case, the solenoid controlled valve may be omitted, and the sensing elements in the refrigerator's ice making system may be tied or coupled directly to the pump motor to cause the pump motor to pump water as required by the ice making system.

While the principles of the invention have been made clear in illustrative embodiments, there will be immediately obvious to those skilled in the art many modifications of structure, arrangement, proportions, the elements, materials and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Apparatus for providing water from a container to an ice maker in a refrigerator having water sensing means, comprising, in combination:

container means for holding a quantity of water;

housing means secured to the container means;

first conduit means extending into the water through which water flows;

pump means in the housing means for pumping water through the first conduit means from the container means;

second conduit means extending from the pump means to the water sensing means through which water is pumped;

pressure sensing means in the second conduit means for sensing pressure in the second conduit means;

check valve means in the second conduit means between the pump means and the pressure sensing means for allowing water to flow in the second conduit means from the pump means toward the ice maker but preventing water from flowing backwards from the ice maker to the pump means in the second conduit means;

motor means connected to the pump means for pumping water from the container means through the first conduit means and the second conduit means to the ice maker; and electrical circuit means for providing an electrical current to, and for controlling, the motor means, including means responsive to a drop in the pressure sensed by the pressure sensing means for providing an electrical current to the motor means, means for sensing a predetermined minimum water level in the container means secured to the first conduit means, and switch means responsive to the sensing of the predetermined minimum water level for disconnecting the electrical current between the pressure sensing means and the motor means for preventing the actuation of the motor means when the water level drops below the predetermined minimum water level.

2. The apparatus of claim 1 in which the first conduit means includes an end disposed in the water and the means for sensing a predetermined water level includes a first conductor and a second conductor spaced apart from each other and extending into the water, and each conductor has a bottom disposed slightly above the end of the first conduit means.

3. The apparatus of claim 2 in which the first and second conductors are disposed generally parallel to each other.

4. The apparatus of claim 1 in which the pressure sensing means includes means for sensing a pressure drop in the second conduit means indicative of the opening of the water sensing means in the refrigerator to provide water for the ice maker, and the means responsive to a drop in the pressure sensed by the pressure sensing means, including switch means having an open state when the pressure in the second conduit means is above a first predetermined pressure and having a closed state for providing an electrical current to the motor means when the pressure in the second conduit means is below a second predetermined pressure.

5. The apparatus of claim 1 in which the second conduit means further includes prime switch means for venting the second conduit means.

6. The apparatus of claim 1 in which the second conduit means includes bleed means for bleeding air from the first conduit means.

7. The apparatus of claim 6 in which the bleed means further includes means for draining water from the second conduit means and for returning the drained water to the container means.

8. The apparatus of claim 1 in which the housing means includes vent means for venting the container means to atmospheric pressure.

* * * * *